US005634987A

United States Patent [19]

Zhang et al.

[11] Patent Number: 5,634,987

[45] Date of Patent: Jun. 3, 1997

[54] MAGNETIC MATERIALS AND METHOD OF MAKING THEM

[75] Inventors: Pengzhen Zhang, Wimborne; Robert A. Buckley; Hywel A. Davies, both of Sheffield, all of United Kingdom; Azwar Manaf, Jakarta Selatan, Indonesia

[73] Assignee: The University of Sheffield, Sheffield, United Kingdom

[21] Appl. No.: 367,171

[22] PCT Filed: Jul. 15, 1993

[86] PCT No.: PCT/GB93/01476

§ 371 Date: Apr. 5, 1995

§ 102(e) Date: Apr. 5, 1995

[87] PCT Pub. No.: WO94/02950

PCT Pub. Date: Feb. 3, 1994

[30] Foreign Application Priority Data

Jul. 16, 1992 [GB] United Kingdom ..... 9215109

[51] Int. Cl.[6] ..... H01F 1/057

[52] U.S. Cl. ..... 148/302; 420/83; 420/121; 252/62.54; 148/101; 164/463; 164/477

[58] Field of Search ..... 164/463, 477; 148/101, 102, 121, 302; 420/83, 121; 252/62.54

[56] References Cited

U.S. PATENT DOCUMENTS

| | | | |
|---|---|---|---|
| 4,802,931 | 2/1989 | Croat | 148/302 |
| 4,834,811 | 5/1989 | Keem et al. | 148/101 |
| 4,854,979 | 8/1989 | Wecker | 148/103 |
| 4,913,745 | 4/1990 | Sato | 148/103 |
| 5,056,585 | 10/1991 | Croat | 164/463 |
| 5,172,751 | 12/1992 | Croat | 148/101 |

FOREIGN PATENT DOCUMENTS

| | | |
|---|---|---|
| 0 101 552 | 2/1984 | European Pat. Off. . |
| 0 108 474 | 5/1984 | European Pat. Off. . |
| 0 195 219 | 9/1986 | European Pat. Off. . |
| 0229946 | 7/1987 | European Pat. Off. . |

*Primary Examiner*—John Sheehan

*Attorney, Agent, or Firm*—Watson Cole Stevens Davis, P.L.L.C.

[57] ABSTRACT

A method for the preparation of a two-phase magnetic material that includes as the major phase a crystalline alloy of one or more rare earth metals, boron and iron, substantially all of the crystallites of which have a size of less than 35 nanometers, and as the minor phase α-Fe, involves the steps of (i) melt spinning an alloy consisting of up to 12 atomic percent of one or more rare earth metals, 3 to 7 atomic percent of boron and the balance iron or a mixture of iron and cobalt; (ii) quenching the melt spun alloy form step (i) under conditions such that a mixture of crystalline and amorphous material is produced, (iii) subjecting the material from step (ii) to an annealing treatment under conditions such that controlled crystal growth occurs to provide the crystalline alloy phase, substantially all of which has a particle size of less than 35 nanometers, the resulting materials having a remanence in excess of the theoretical value of 0.8 Tesla.

17 Claims, No Drawings

MAGNETIC MATERIALS AND METHOD OF MAKING THEM

BACKGROUND OF THE INVENTION

The present invention relates to magnetic materials and, in particular, to two-phase magnetic materials comprising a mixture of a crystalline phase of an alloy of Fe, B and R, where R is a rare earth element and α-Fe.

Magnetic materials and permanent magnets are important materials which are used in many fields, including electrical appliances and electronic devices. In view of the increasing requirement for miniaturization and the greater demands placed on electrical appliances and electronic devices there has been an increasing demand for improved magnetic materials and permanent magnets.

EP-A-0101552 describes magnetic materials based on alloys of the type Fe—B—R containing at least one stable compound of the ternary Fe—B—R type, where R is a rare earth element including yttrium, which compound can be magnetized to become a permanent magnet. The amount of rare earth R is generally in the range of from 8 to 30 atomic percent.

EP-A-0108474 describes a magnetically hard alloy composition comprising at least 10 atomic percent of one or more rare earth elements, 0.5 to 10 atomic percent of boron; and iron or mixtures of iron with a transition metal element, the alloy containing a major portion of a magnetically hard, fine crystallites having an average diameter of less than 400 nanometers.

The materials described in the above patents have generally exhibited the highest remanence when the percentage of rare earth present in the alloy is about 12 atomic percent.

Previously, attempts to produce magnetically hard alloy compositions similar to those described in EP-A-0101552 and EP-A-0108474, but comprising less than 10 atomic percent of the rare earth metal, have produced products with a low remanence and energy product, the latter being attributed to the presence of α-Fe.

Existing theories, such as those developed by Stoner and Wohlfarth, for the expected properties of isotropic permanent magnet materials, indicate that the remanence should not exceed half the value of the saturation magnetisation. For NdFeB, with a saturation of approximately 1.6 Tesla, the remanence should not be greater than 0.8 Tesla. This maximum value would apply to the stoichiometric composition of NdFeB (2:14:1), which corresponds to about 12 atomic percent Nd, and deviation from this value in either direction will reduce the maximum achievable remanence. If the material can be produced such that the material structure is sufficiently fine and uniform, so that significant magnetic interaction occurs between grains then the remanence can be increased to a level above that predicted by the theory.

EP-A-0195219 describes a hard magnetic alloy of the RE-TM-B type where RE is neodymium or praesodymium, TM is a transition metal chosen from iron, cobalt and nickel and B is boron, and optionally at least one modifier of silicon or combinations of silicon with aluminium, or lithium, hydrogen, fluorine, phosphorus, sulfur, germanium and carbon, the alloy consisting of magnetically, substantially isotropic particles of grains of mainly the tetragonal $RE_2Fe_{14}B$-type phase with other phases being present below the level of detection by X-ray diffraction, said phase having grain sizes in the range of from 10 to 100 nm and a maximum magnetic energy product greater than 119.4 kJ/m$^3$ (15MG0e) in all directions. Magnetic alloys having these properties have only been prepared according to the teaching of EP-A-0195219, with the addition of at least one modifier to the alloy of the RE-TM-B type.

EP-A-0229946 describes an interacting hard magnetic material, comprising an alloy of a rare earth metal and a transition metal. The magnetic material may also contain boron and a modifier.

We have now developed a method for producing magnetic materials from alloy compositions of the type Fe—B—R containing less than or equal to 12 atomic percent of the rare earth element which have a high remanence and energy product, without the need for any additions.

Accordingly, the present invention provides a method for the preparation of a two-phase magnetic material comprising as the major phase a crystalline alloy of one or more rare earth metals, boron and iron, substantially all of the crystallites of which have a size of less than 35 nanometers, and as the minor phase α-Fe, which method comprises the steps of i) melt spinning an alloy consisting of up to 12 atomic percent of one or more rare earth metals, 3 to 7 atomic percent of boron and the balance iron or a mixture of iron and cobalt;

ii) quenching the melt spun alloy from step (i) under conditions such that a mixture of crystalline and amorphous material is produced, iii) subjecting the material from step (ii) to an annealing treatment under conditions such that controlled crystal growth occurs to provide the crystalline alloy phase, substantially all of which has a particle size of less than 35 nanometers, the resulting materials having a remanence in excess of the theoretical value of 0.8 Tesla.

The alloy composition which is melt spun in the method of the invention may contain up to 12 atomic percent of the rare earth metal. This is slightly above the atomic percentage level of rare earth in the stoichiometric composition $RE_2Fe_{14}B$, of about 11.7%. However, on melt spinning alloy compositions containing rare earth metals in accordance with the method of the present invention some of the rare earth element is lost from the composition and thus alloys with levels of rare earth metals slightly above the 11.7% limit of the stoichmetric composition melt spun in accordance with the present invention can produce the desired two-phase compositions.

The alloy composition which is melt spun in the method of the present invention preferably contains neodymium as the rare earth element, the amount of neodymium preferably being in the range of from 8 to 10 atomic percent. The alloy composition which is melt spun preferably comprises from 4 to 7 atomic percent of boron, more preferably from 4 to 6 atomic percent.

The alloy compositions which are melt spun in accordance with the present invention contain a balance of iron, or of a mixture of iron and cobalt. Typically cobalt may replace iron in the compositions in an amount of up to 10 to 15% by weight. The replacement of a part of the iron by cobalt in the magnetic alloy compositions generally results in an improvement in the temperature coefficient and some modification to the magnetic properties.

In carrying out the method of the invention, the alloy composition in the melt spinning step (i) is preferably maintained at a temperature of about 50° C. above its melting point. The general technique of melt spinning is, of course, well known in the art.

The melt spun alloy produced in step (i) of the method is quenched under conditions such that a mixture of crystalline and amorphous material is produced. Preferably the melt spun alloy is quenched by dropping onto a water-cooled rotating wheel or chill roll. The speed of the rotating wheel or chill roll and the temperature thereof are chosen so that a partly crystalline and partly amorphous material is produced. The alloy is not over-quenched, which produces an amorphous material, it being important that the two-phase material is produced.

The presence of crystallites in the as quenched material assists in the formation of a uniform fine grain size structure in the annealing step (iii) of the method of the invention. With a purely amorphous product there is an onset time before any crystals grow and this tends to produce coarse crystals greater than 35 nanometers with a wide range of crystal sizes. However, if as in the present invention there is a mixture of crystalline and amorphous products, the crystallites act as seeds for the basic alloy to grow crystals from the amorphous phase.

The material produced in step (ii) of the method thus preferably comprises from 10 to 50% by volume of amorphous material, more preferably from 20 to 30% by volume of amorphous material.

The annealing treatment in step (iii) of the method of the invention is carried out under conditions such that the amorphous material is converted to crystalline form. A sufficiently high temperature is required to promote devitrification. The temperature should not be so high, or the treatment time so long, that excessive grain growth is promoted. Suitable conditions may comprise rapidly heating the material to a temperature in the range of from 650° to 800° C., maintaining the material at this temperature for a period of from 1 to 20 minutes, preferably 2 to 10 minutes, and thereafter rapidly cooling the material to room temperature. The material which is produced in stage (iii) of the method may be powdered prior to stage (iii). The annealing treatment may be carried out in a vacuum, or under an inert gas atmosphere.

The magnetic material which is produced by the method of the present invention is a two-phase material comprising as the first major phase a crystalline alloy substantially all of the crystallites of which have a particle size of less than 35 nanometers, preferably of less than 25 nanometers. The major phase of the annealed material preferably comprises at least 60% by volume of the material. The proportion of any minor phase of α-Fe will tend to decrease with an increase in the rare earth content of the alloy.

The two-phase magnetic materials produced in accordance with the method of the invention possess a remanence above the theoretical value of 0.8 Tesla, generally above 0.9 Tesla and preferably having a remanence of greater than 1 Tesla. The materials preferably have a coercivity in the range of 350 to 900 $KAm^{-1}$.

The two-phase magnetic materials may be fabricated into bonded magnets by bonding with a suitable resin, for example an epoxy resin. Generally above 75% by volume of the two-phase magnetic material will be bonded with the epoxy resin, preferably about 80% by volume of the magnetic material will be used. The bonded magnets comprising about 80% by volume of the magnetic material will preferably have a maximum energy product of not less than 80 $kJm^{-3}$, more preferably a maximum energy product of not less than 88 $kJm^{-3}$.

The present invention will be further described with reference to the following Examples.

EXAMPLE 1

An alloy of the composition $Nd_8Fe_{86}B_6$ in the form of a 20 g ingot was melt spun under the following conditions:

| | |
|---|---|
| Chamber atmosphere | argon |
| Nozzle size | 0.55 mm |
| Ejection pressure | $4 \times 10^4$Pa (argon) |
| Roll Speed | 20.5 m/sec |

The ribbon material comprised a mixture of about 80% by volume crystalline material and about 20% by volume of amorphous material.

The ribbon material was then crushed to a particle size of <150 μm and loaded into a silica tube and sealed under vacuum ($<10^{-4}$ torr).

The powder was then heat treated at a temperature of 700° C. for 2 minutes and then water quenched.

The powder material had a remanence of 1.02 T and a coercivity of 360 $kAm^{-1}$.

The resulting powder was bonded in an amount of about 80% by volume with an epoxy resin. The bonded product had an energy product of 88 $kJm^{-3}$.

EXAMPLE 2

The procedure of Example 1 was repeated using an alloy of the composition $Nd_9Fe_{86}B_5$.

The ribbon material produced comprised a mixture of about 80% by volume crystalline material and about 20% by volume of amorphous material.

The ribbon material was then crushed and heat treated as in Example 1. The powder material had a remanence of 1.11 and a coercivity of 480 $kAm^{-1}$. The resulting powder was bonded with an epoxy resin in an amount of about 80% by volume. The bonded product had an energy product of 93 $kJm^{-3}$.

EXAMPLE 3

The procedure of Example 1 was repeated using an alloy of the composition $Nd_9Fe_{85}B_6$.

The ribbon material produced comprised a mixture of about 80% by volume crystalline material and about 20% by volume of amorphous material.

The ribbon material was then crushed and heat treated as in Example 1. The powder material had a remanence of 1.10 T and a coercivity of 505 $kAm^{-1}$. The resulting powder was bonded with an epoxy resin in an amount of about 80% by volume. The bonded product had an energy product of 92 $kJm^{-3}$.

EXAMPLE 4

The procedure of Example 1 was repeated using an alloy of composition $Nd_{10}Fe_{85}B_5$.

The ribbon material produced comprised a mixture of about 80% by volume crystalline material and about 20% by volume of amorphous material.

The ribbon was then heat treated at a temperature of 700° C. for 2 minutes. The ribbon had a remanence of 1.02 T, and an intrinsic coercivity 535 kA/m.

The ribbon material was then crushed and the resulting powder polymer bonded with an epoxy resin in an amount of about 80% by volume.

EXAMPLE 5

The procedure of Example 1 was repeated using an alloy of the composition $Nd_{11}Fe_{83}B_6$.

The ribbon material produced comprised a mixture of about 80% by volume crystalline material and 20% by volume of amorphous material. The ribbon was then heat treated at a temperature of 750° C. for 10 minutes. The ribbon had a remanence of 0.95 T and an intrinsic coercivity of 690 KA/m.

The ribbon material was then crushed and the resulting product polymer bonded with an epoxy resin in an amount of about 80% by volume. The bonded powder had an energy product of 95 $kJm^{-3}$ and an intrinsic coercivity of 660 KA/m.

We claim:

1. A method for the preparation of a two-phase magnetic material comprising as the major phase a crystalline alloy of at least one rare earth metal, boron and iron, substantially all of the crystallites of which have a size of less than 35 nanometers, and as the minor phase α-Fe, which method comprises the steps of:

i) melt spinning an alloy consisting of up to 12 atomic percent of at least one rare earth metal, 3 to 7 atomic percent of boron and the balance iron or a mixture of iron and cobalt;

ii) quenching the melt spun alloy from step (i) under conditions such that a mixture of crystalline and amorphous material is produced;

iii) subjecting the material from step (ii) to an annealing treatment under conditions such that controlled crystal growth occurs to provide the crystalline alloy phase, substantially all of which has a crystallite size of less than 35 nanometers, the resulting materials having a remanence in excess of the theoretical value of 0.8 Tesla.

2. A method as claimed in claim 1 wherein the rare earth metal of the alloy is neodymium.

3. A method as claimed in claim 1 wherein the rare earth metal is present in the alloy which is melt spun in an amount of from 8 to 10 atomic percent.

4. A method as claimed in claim 1 wherein the alloy which is melt spun comprise from 4 to 6 atomic percent of boron.

5. A method as claimed in claim 1 wherein substantially all of the crystalline alloy phase comprises crystallites having a size of less than 25 nanometers.

6. A method as claimed in claim 1 wherein the material produced in step (ii) comprises from 10 to 50% by volume of amorphous material.

7. A method as claimed in claim 6 wherein the material produced in step (ii) comprises 20 to 30% by volume of amorphous material.

8. A method as claimed in claim 1 wherein the alloy is quenched by dropping onto a water-cooled rotating wheel or chill roll.

9. A method as claimed in claim 1 wherein the material produced in stage (ii) is powdered in stage (iii).

10. A method as claimed in claim 1 wherein the annealing treatment comprises rapidly heating the material to a temperature in the range of from 650° to 800° C., maintaining the material at this temperature for a period of from 1 to 20 minutes and thereafter rapidly cooling the material to room temperature.

11. A method as claimed in claim 1 wherein the alloy in the melt spinning step (i) is maintained at a temperature of about 50° C. above its melting point.

12. A powdered magnetic material which has a remanence greater that 0.9 T which has been produced by a method which comprises the steps of:

i) melt spinning an alloy consisting of up to 12 atomic percent of at least one rare earth metal, 3 to 7 atomic percent of boron and the balance selected from the group consisting of iron and a mixture of iron and cobalt;

ii) quenching the melt spun alloy from step (i) under conditions such that a mixture of crystalline and amorphous material is produced;

iii) subjecting the material from step (ii) to an annealing treatment under conditions such that controlled crystal growth occurs to provide the crystalline alloy phase, substantially all of which has a crystallite size of less than 35 nanometers; and iv) crushing the material from step (iii) to form a powder.

13. A powdered magnetic material as claimed in claim 12 which has a remanence greater than 1T.

14. A powdered magnetic material which has a coercivity of 350 to 900 $kAm^{-1}$ which has been produced by a method which comprises the steps of:

i) melt spinning an alloy consisting of up to 12 atomic percent of at least one rare earth metal, 3 to 7 atomic percent of boron and the balance selected from the group consisting of iron and a mixture of iron and cobalt;

ii) quenching the melt spun alloy from step (i) under conditions such that a mixture of crystalline and amorphous material is produced;

iii) subjecting the material from step (ii) to an annealing treatment under conditions such that controlled crystal growth occurs to provide the crystalline alloy phase, substantially all of which has a crystallite size of less than 35 nanometers, the resulting materials having a remanence in excess of the theoretical value of 0.8 Tesla; and iv) crushing the material from step (iii) to form a powder.

15. A bonded magnet which is formed by bonding a powder of a magnetic material which has been produced by a method which comprises the steps of:

i) melt spinning an alloy consisting of up to 12 atomic percent of at least one rare earth metal, 3 to 7 atomic percent of boron and the balance selected from the group consisting of iron and a mixture of iron and cobalt;

ii) quenching the melt spun alloy from step (i) under conditions such that a mixture of crystalline and amorphous material is produced;

iii) subjecting the material from step (ii) to an annealing treatment under conditions such that controlled crystal growth occurs to provide the crystalline alloy phase, substantially all of which has a crystallite size of less than 35 nanometers, the resulting materials having a remanence in excess of the theoretical value of 0.8 Tesla; and iv) crushing the material from step (iii) to form a powder.

16. A bonded magnet as claimed in claim 15, comprising 80% by volume of the magnetic material and having a maximum energy product of not less than 80 $kJm^{-3}$.

17. A bonded magnet as claimed in claim 15 comprising 80% by volume of the magnetic material and having a maximum energy product greater than 88 $kJm^{-3}$.

* * * * *

UNITED STATES PATENT AND TRADEMARK OFFICE

CERTIFICATE OF CORRECTION

PATENT NO. : 5,634,987

DATED : June 3, 1997

INVENTOR(S) : Zhang et al.

It is certified that error appears in the above-indentified patent and that said Letters Patent is hereby corrected as shown below:

On the title page:Item

[22] PCT Filed: Jul. 14, 1993

Signed and Sealed this

Nineteenth Day of August, 1997

*Attest:*

Bruce Lehman

BRUCE LEHMAN

*Attesting Officer*

*Commissioner of Patents and Trademarks*